US005980314A

United States Patent [19]

Roberts

[11] Patent Number: 5,980,314

[45] Date of Patent: Nov. 9, 1999

[54] ELECTRICAL CONNECTOR WITH IMPROVED BOARD MOUNTING PEG

[75] Inventor: James T. Roberts, Oak Park, Ill.

[73] Assignee: Molex Incorporated, Lisle, Ill.

[21] Appl. No.: 09/042,242

[22] Filed: Mar. 13, 1998

[51] Int. Cl.[6] ..... H01R 13/73

[52] U.S. Cl. ..... 439/567

[58] Field of Search ..... 439/567, 557, 439/571–573

[56] References Cited

U.S. PATENT DOCUMENTS

| | | | |
|---|---|---|---|
| 4,384,754 | 5/1983 | Douty et al. | 339/17 M |
| 4,435,031 | 3/1984 | Black et al. | 339/17 C |
| 4,477,142 | 10/1984 | Cooper et al. | 339/125 R |
| 4,664,458 | 5/1987 | Worth | 339/17 M |
| 4,688,875 | 8/1987 | O'Connor | 439/676 |
| 4,755,149 | 7/1988 | de Jong et al. | 439/248 |
| 4,767,355 | 8/1988 | Phillipson et al. | 439/425 |
| 4,824,398 | 4/1989 | Taylor | 439/557 |
| 4,850,902 | 7/1989 | Reed | 439/676 |
| 4,953,061 | 8/1990 | Nitkiewicz | 361/417 |
| 5,071,371 | 12/1991 | Harwath et al. | 439/637 |
| 5,112,235 | 5/1992 | Enomoto et al. | 439/83 |
| 5,181,854 | 1/1993 | Masuda | 439/67 |
| 5,230,638 | 7/1993 | DiViesti | 439/567 |
| 5,244,412 | 9/1993 | Hatch et al. | 439/567 |
| 5,257,947 | 11/1993 | Scheer et al. | 439/567 |
| 5,328,389 | 7/1994 | Lewis et al. | 439/567 |
| 5,334,048 | 8/1994 | Bowers et al. | 439/567 |
| 5,364,294 | 11/1994 | Hatch et al. | 439/676 |
| 5,435,750 | 7/1995 | Kosmala | 439/567 |
| 5,613,877 | 3/1997 | Patel et al. | 439/567 |
| 5,690,513 | 11/1997 | Fink et al. | 439/567 |
| 5,697,812 | 12/1997 | Sampson et al. | 439/567 |

*Primary Examiner*—Gary Paumen
*Attorney, Agent, or Firm*—Stephen Z. Weiss

[57] ABSTRACT

An electrical connector is adapted for mounting to a surface of a printed circuit board having a mounting hole leading to a remote surface of the board. The connector includes a dielectric housing having terminals mounted therein and including a board-mounting face. At least one mounting peg projects from the board-mounting face for insertion into the mounting hole in the printed circuit board. The mounting peg is bifurcated to define a pair of legs separated by an axial slit. The legs have arcuate board-mounting surfaces on the outside thereof. The arcuate surface of at least one of the legs is flattened to define a pair of circumferentially spaced end portions.

8 Claims, 2 Drawing Sheets

ELECTRICAL CONNECTOR WITH IMPROVED BOARD MOUNTING PEG

FIELD OF THE INVENTION

This invention generally relates to the art of electrical connectors and, particularly, to a novel structure of a mounting peg or post for securing an electrical connector to a printed circuit board through a hole in the board.

BACKGROUND OF THE INVENTION

It is known to provide electrical connectors with means for securing the connector to a printed circuit board. Often, the connector has a molded thermoplastic housing and a boardlock means is formed integral therewith. The connector is secured temporarily on the printed circuit board by the boardlock until electrical connections are made, as by soldering. The boardlock holds a connector mounting face firmly in contact with the printed circuit board until permanently secured thereagainst, such as a result of the soldering process.

A popular form of boardlock is a snap latch for securing a connector block or housing to the printed circuit board. The snap latch typically is a molded plastic peg which is bifurcated to define a pair of resilient legs having latching barbs or hooks thereon. The legs, during insertion through a hole in the printed circuit board from a first side of the board, deflect inwardly toward the axis of the snap latch. As the hooks on the ends of the legs pass through the hole in the board, the legs snap back outwardly into a position with shoulders on the hooks extending beyond the periphery of the hole and engaging a second side of the board, thereby securing the connector to the board. The pegs usually are an integral part of the connector housing or, in some instances, separate metal snap latches have been used.

Such snap latch boardlocks described above have proven quite effective when employed with relatively large holes in the printed circuit board. However, with the ever-increasing miniaturization of electronic components, miniature snap latches of the bifurcated peg type have proven to be extremely fragile, prone to breakage, unstable and lacking in sufficient retention capabilities. This problem of breakage is particularly prevalent with the brittle plastic material which presently is used quite often in molding connector housings, even when the boardlock peg is not extremely miniaturized. With such brittle materials, the pegs are even prone to breakage when simply inserted into the hole in the printed circuit board. The present invention is directed to solving these problems in a typical bifurcated mounting peg by reducing the deflection required to insert the peg into the hole in the circuit board.

SUMMARY OF THE INVENTION

An object, therefore, of the invention is to provide a new and improved electrical connector of the character described above, with a novel mounting peg structure.

In the exemplary embodiment of the invention, the electrical connector is adapted for mounting to a surface of a printed circuit board having a mounting hole leading to a remote surface of the board. The connector includes a dielectric housing having terminals mounted therein and including a board-mounting face. At least one mounting peg projects from the board-mounting face for insertion into the mounting hole in the printed circuit board. The mounting peg is bifurcated to define a pair of legs separated by an axial slit. The legs have arcuate board-mounting surfaces on the outside thereof. The arcuate surface of at least one of the legs is flattened to define a pair of circumferentially spaced end portions.

As disclosed herein, the legs have generally hooked configurations defining axially rearwardly facing, arcuate latching surfaces for engaging the remote surface of the printed circuit board. Therefore, the flattened leg defines a pair of circumferentially spaced latching surfaces. The invention contemplates that the outside surfaces on the outside of both of the legs may be flattened. The housing may be molded of plastic material, with the mounting peg being unitarily molded therewith. A plurality of the mounting pegs may be molded to project from the board-mounting face of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
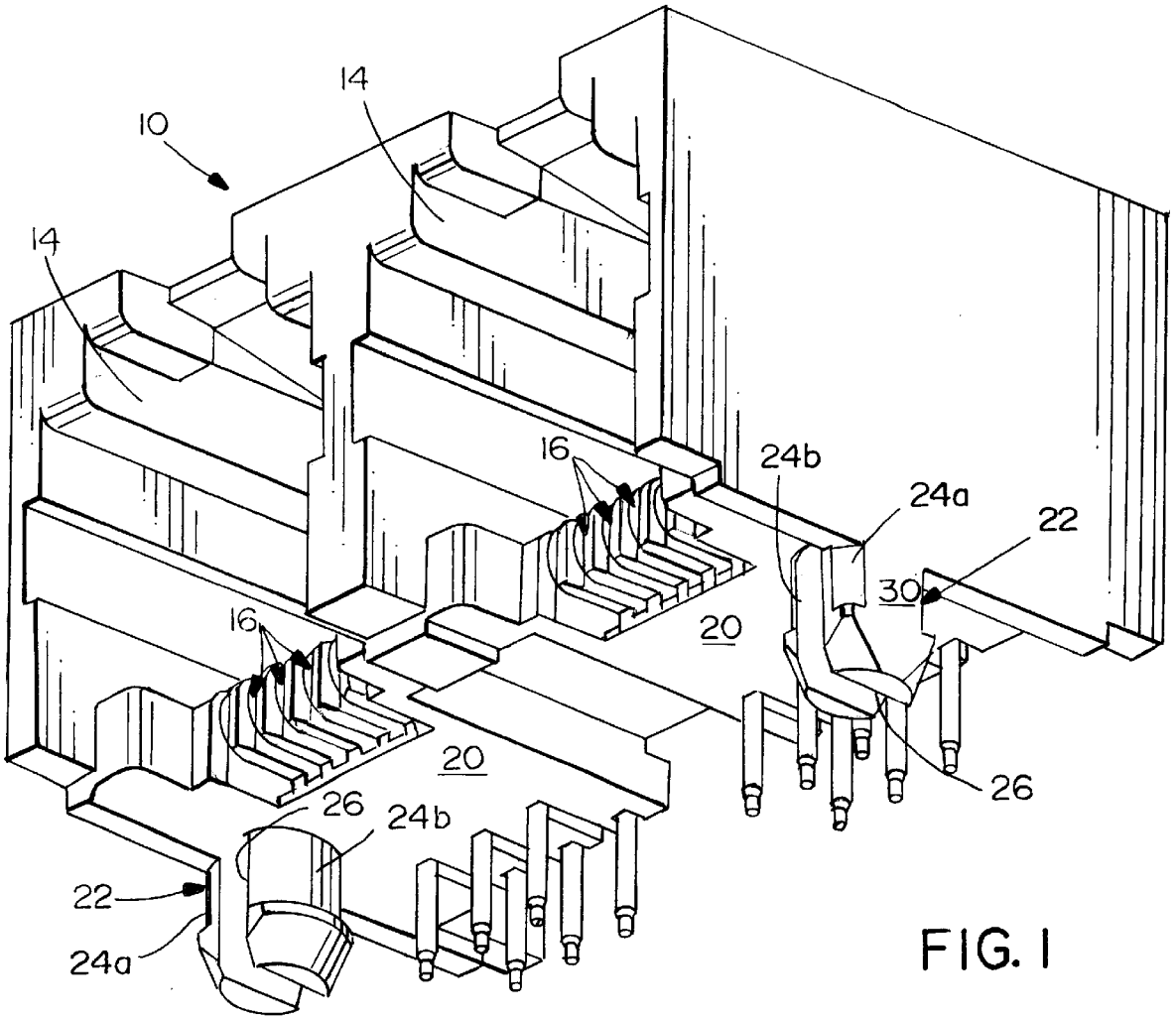
FIG. 1 is a bottom perspective view of an electrical connector having a pair of mounting pegs according to the invention.

Referring to the drawings in greater detail, and first to FIG. 1, the invention is embodied in an electrical connector, generally designated 10, which is a typical two-receptacle modular jack. The connector includes a dielectric housing, generally designated 12, defining a pair of receptacles 14 for receiving a pair of typical modular jack plugs. The housing mounts a plurality of terminals, generally designated 16, which have tail portions 18 projecting from the housing for insertion into holes in an appropriate printed circuit board to connect the terminals, as by soldering, to circuit traces on the board and/or in the holes. The terminals have cantilevered spring arms (not shown) projecting angularly into receptacles 14 for engaging contacts on the modular jack plugs, as is well known in the art. Finally, housing 12 is a one-piece structure molded of dielectric material such as plastic or the like and including a board-mounting face 20 from which terminal tails 18 project.

The invention is incorporated in a novel structure of a pair of mounting pegs, generally designated 22, which are unitarily molded with housing 12 and projecting from board-mounting face 20. However, it should be understood that the novel features of the mounting pegs are not limited to jack-type connectors nor to unitarily molded connector housings, because it will be understood that the mounting pegs can be used with a wide variety of electrical connector configurations adapted for mounting to a surface of a printed circuit board. In addition, the number of mounting pegs can vary with each connector.

Figure 2:
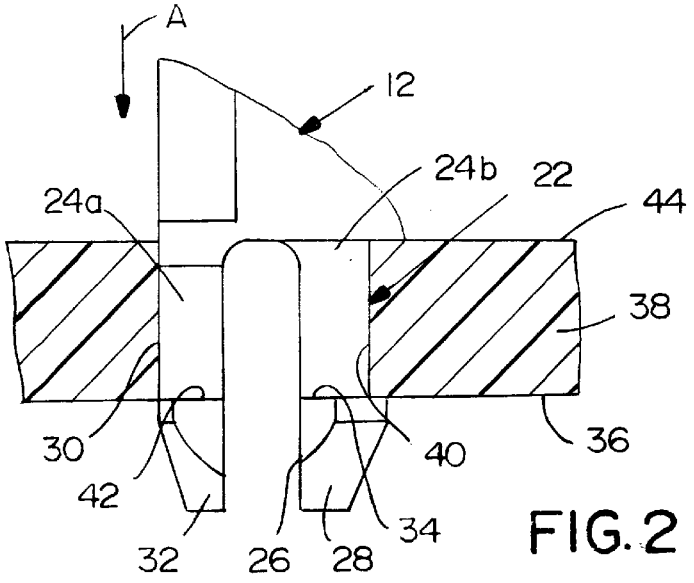
FIG. 2 is a side elevational view of one of the mounting pegs.
Figure 3:
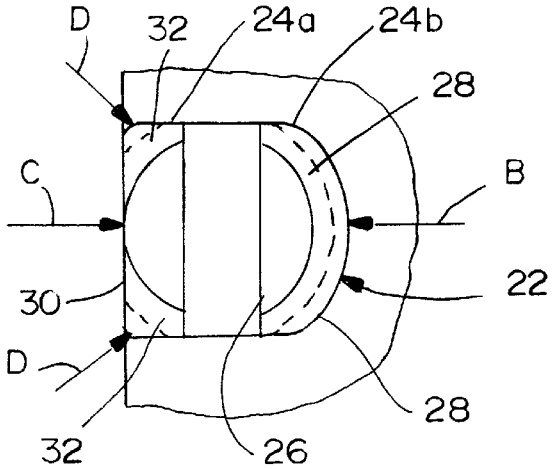
FIG. 3 is a bottom plan view of one of the mounting pegs.

More particularly, referring to FIGS. 2 and 3 in conjunction with FIG. 1, each mounting peg 22 is bifurcated to define a pair of legs 24*a* and 24*b* separated by an axial slit 26. Leg 24*b* has an arcuate board-mounting surface 28 on the outside thereof. Leg 24*a* also has an arcuate "surface" on the outside thereof, but the invention contemplates that the surface is flattened or interrupted, as at 30, to define a pair of circumferentially spaced arcuate end portions 32. Therefore, it can be seen in FIGS. 2 and 3 that arcuate surface 28 of leg 24*b* projects radially outwardly from the center of slit 26 further than the flattened surface or area 30 of leg 24*a*.

Legs 24*a* and 24*b* of mounting peg 22 have generally hooked configurations to define axially rearwardly facing, arcuate latching surfaces for engaging the remote surface of a printed circuit board. More particularly, leg 24*b* has a fairly substantial arcuate latching surface 34 as seen best in FIG. 3. This latching surface engages a remote surface 36 of a printed circuit board 38 when the mounting peg is inserted through a hole 40 in the board as seen in FIG. 2. Because leg 24*a* is flattened at 30, a pair of circumferentially spaced latching surfaces 42 are defined for engaging remote surface 36 of the circuit board.

In operation, when one of the mounting pegs 22 is inserted into a hole 40 in printed circuit board 38 in the direction of arrow "A" (FIG. 2), arcuate board-mounting surfaces 28 and 32 of legs 24*b* and 24*a*, respectively, will engage a surface 44 of the board about hole 40. As best seen in FIG. 2, surfaces 28 and 32 are angled radially inwardly toward the tip of the mounting peg so that legs 24*b* and 24*a* are biased inwardly in the direction of arrows "B" and "C", respectively, (see FIG. 3). Because slit 26 is elongated as seen in FIG. 3, legs 24*a* and 24*b* will move inwardly in a direction generally perpendicular to the slit as indicated by arrows "B" and "C". However, leg 24*b* will move radially inwardly a further distance than leg 24*a* because board-mounting surface 28 and its corresponding latching surface 34 of leg 24*b* projects radially outwardly a greater distance on line with arrow "B" than will leg 24*a* on line with arrow "C". This is because the circumferentially spaced end surface portions 32 and their corresponding circumferentially spaced latching surfaces 42 will engage the perimeter of hole 40 on a force vector defined by arrows "D" (FIG. 3). Since these forces are at an angle to the direction "C" which leg 24*a* will deflect, the leg will not deflect as much as leg 24*b* will deflect and, consequently, there is much less of a tendency for leg 24*a* to break from excessive stresses. Yet, once the mounting peg is fully inserted through hole 40 in the circuit board, the cross-sectional masses of legs 24*a* and 24*b* within the hole, which secure the connector in the hole, are substantially equal.

Figure 4:
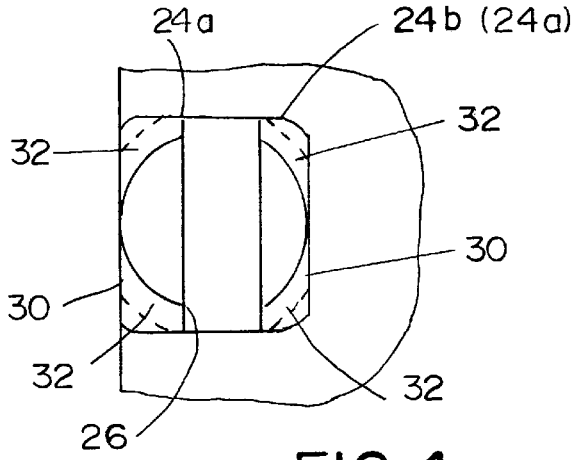
FIG. 4 is a bottom plan view of a mounting peg with both legs flattened.

FIG. 4 simply shows an alternative embodiment wherein a mounting peg is provided with two legs 24*a* having flattened areas 30 so that the amount of deflection of the legs normal to slit 26 are substantially reduced. Consequently, like numerals have been applied in FIG. 4 corresponding to like elements described above in relation to FIGS. 1–3, except to the extent that the mounting peg in FIG. 4 has two legs corresponding to leg 24*a* in the previous figures.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector adapted for mounting to a surface of a printed circuit board having a mounting hole leading to a remote surface of the board, comprising:

a dielectric housing having terminals mounted therein and including a board-mounting face; and at least one mounting peg projecting from the board-mounting face for insertion into the mounting hole in the printed circuit board, the mounting peg being bifurcated to define a pair of legs separated by an axial slit, the legs having arcuate board-mounting surfaces on the outside thereof, and the arcuate surface of at least one of said legs being flattened in a central region thereof to define a pair of circumferentially spaced end arcuate portions.

2. The electrical connector of claim 1 wherein the arcuate surfaces on the outside of both of said legs are flattened.

3. The electrical connector of claim 1 wherein said legs have generally hooked configurations defining axially rearwardly facing, arcuate latching surfaces for engaging the remote surface of the printed circuit board, whereby said flattened leg defines a pair of circumferentially spaced latching surfaces.

4. The electrical connector of claim 3 wherein the arcuate surfaces on the outside of both of said legs are flattened.

5. The electrical connector of claim 1, including a plurality of said mounting pegs projecting from the board-mounting face of the housing.

6. The electrical connector of claim 1 wherein said dielectric housing is molded of plastic material with the mounting peg being unitarily molded therewith.

7. An electrical connector adapted for mounting to a surface of a printed circuit board having a plurality of mounting holes leading to a remote surface of the board, comprising:

a dielectric housing molded of plastic material and including a board-mounting face, with a plurality of terminals mounted in the housing;

a plurality of mounting pegs molded integrally with the housing and projecting from the board-mounting face for insertion into the mounting holes in the printed circuit board, each mounting peg being bifurcated to define a pair of legs separated by an axial slit, the legs of each mounting peg having arcuate board-mounting surfaces on the outside thereof, the legs of each mounting peg having generally hooked configurations defining axially rearwardly facing arcuate latching surfaces for engaging the remote surface of the printed circuit board, and the arcuate surface of at least one of the legs of at least one of the mounting pegs being flattened in a central region thereof to define a pair of circumferentially spaced end arcuate portions and a corresponding pair of circumferentially spaced latching surfaces.

8. The electrical connector of claim 7 wherein the arcuate surfaces on the outside of both legs of said at least one mounting peg are flattened.

* * * * *